US007114268B2

(12) United States Patent
Müller

(10) Patent No.: US 7,114,268 B2
(45) Date of Patent: Oct. 3, 2006

(54) DRYING SECTION AND A SMOOTHING APPARATUS FOR SUCH A DRYING SECTION

(75) Inventor: Jens Müller, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 222 days.

(21) Appl. No.: 10/273,160

(22) Filed: Oct. 17, 2002

(65) Prior Publication Data

US 2003/0110660 A1 Jun. 19, 2003

(30) Foreign Application Priority Data

Oct. 18, 2001 (DE) ..... 101 51 456
Oct. 18, 2001 (DE) ..... 101 51 457

(51) Int. Cl.
*D21F 5/00* (2006.01)

(52) U.S. Cl. ..... 34/117; 162/358.5

(58) Field of Classification Search ..... 34/443, 34/117; 162/358.5

See application file for complete search history.

(56) References Cited

U.S. PATENT DOCUMENTS

| | | | | |
|---|---|---|---|---|
| 4,584,059 | A * | 4/1986 | Schiel et al. | 162/361 |
| 5,127,168 | A * | 7/1992 | Pikulik | 34/423 |
| 5,666,741 | A * | 9/1997 | Bubik et al. | 34/117 |
| 6,012,234 | A | 1/2000 | Schiel | |
| 6,065,222 | A | 5/2000 | Kuhasalo et al. | 34/117 |
| 6,189,442 | B1 | 2/2001 | Honkalampi et al. | |
| 6,203,307 | B1 | 3/2001 | Neider et al. | |
| 6,221,214 | B1 * | 4/2001 | Kotitschke et al. | 162/210 |
| 6,306,261 | B1 | 10/2001 | Meschenmoser et al. | 162/358.5 |
| 6,743,339 | B1 * | 6/2004 | Nilsson et al. | 162/358.2 |

FOREIGN PATENT DOCUMENTS

| | | | |
|---|---|---|---|
| DE | 43 28 505 A1 | 3/1995 | |
| DE | 195 40 898 A1 | 5/1997 | |
| DE | 19548307 | 6/1997 | 13/8 |
| DE | 19602697 | 6/1997 | 13/8 |
| DE | 4407405 | 3/2000 | |
| DE | 19604675 | 4/2001 | 5/4 |

(Continued)

OTHER PUBLICATIONS

Die Papierfabrikation und Deren Maschinen, Müller, 1928.

*Primary Examiner*—S. Gravini
(74) *Attorney, Agent, or Firm*—Taylor & Aust, P.C.

(57) ABSTRACT

A drying section of a machine for the manufacture of a material web, in particular of a paper or of a board web, comprises a smoothing nip which is extended in the web running direction and is formed between two pressing areas lying opposite one another of which at least one is formed by a shoe roll, with at least 70%, and preferably at least 90%, of the outer shoe roll diameter lying above the machine base. In a method for the combined drying and smoothing of a material web, in particular of a paper web or of a board web, in a drying section, the following steps are provided:

Figure 1:
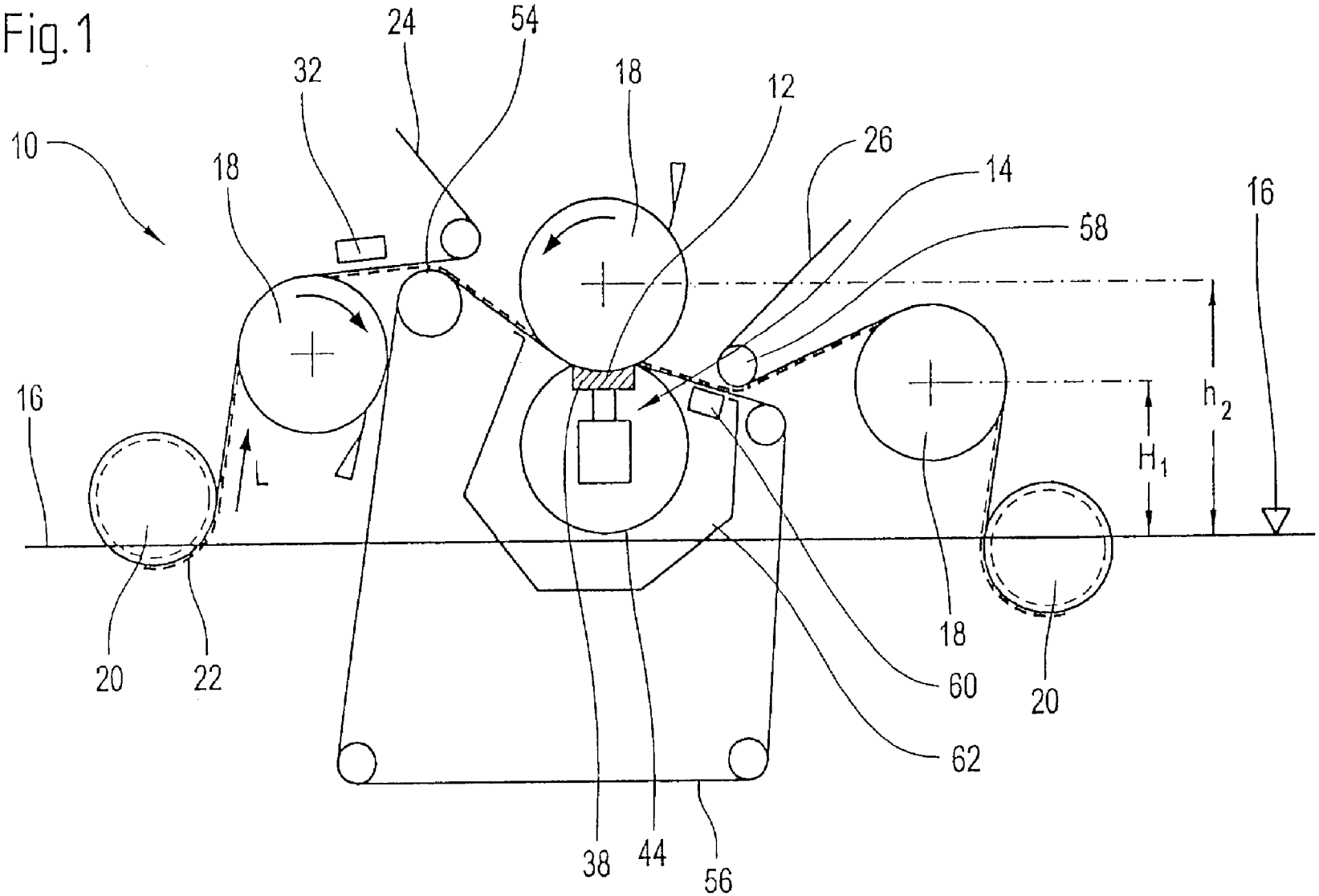

the material web is first dried to a pre-settable drying content >60%, in particular >65%, and preferably >70%;

the material web having this pre-settable drying content is guided through a smoothing nip which is extended in the web running direction and is formed between two pressing surfaces lying opposite one another of which at least one is formed by a rotating belt and of which at least one is heated;

the pressing time resulting in the extended smoothing nip is selected >0.8 ms; and the material web is further dried after the smoothing nip.

49 Claims, 8 Drawing Sheets

FOREIGN PATENT DOCUMENTS

| | | |
|---|---|---|
| EP | 0 451 449 A1 | 2/1991 |
| WO | WO 93/23613 | 11/1993 |
| WO | WO 99/64671 | 12/1999 |

* cited by examiner

DRYING SECTION AND A SMOOTHING APPARATUS FOR SUCH A DRYING SECTION

In accordance with a first aspect, the invention relates to a drying section of a machine for the manufacture of a material web, in particular of a paper web or of a board web, and to a smoothing apparatus, in particular for use in such a drying section.

Drying sections with an integrated smoothing apparatus are known, for example, from the publications DE 196 02 697 A1, DE 195 48 307 A1, DE 196 04 675 C2, DE 44 07 405 C2 and from F. Müller: "Die Papierfabrikation und deren Maschinen II", (Paper Fabrication and its Machinery II) Deutsche Presse, 1928.

In the previously usual smoothing apparatuses provided in the drying section, the smoothing nips are formed by roll pairs. With fast-running paper making machines, the residence time of the material web in the smoothing nip is too short with thickness calenders of this kind so that no sufficient smoothness can be produced. A further disadvantage consists of the fact that the pressure increase, or the pressure gradient, adopted in the roll nip is too large, which can result in an impairment of the paper web. In addition, the shape of the smoothing pressure profile in the running direction of the machine or of the web cannot be chosen as desired, but is dependent on the roll diameters. However, it is now often necessary to change the pressure profile in the machine running direction for different types of paper. An optimum smoothing result, without a negative influencing of the remaining paper quality parameters, is not possible without such a matching of the pressure profile. With these conventional smoothing apparatuses, moreover, no influencing of the transverse smoothing profile is possible, either.

An aim of the invention in accordance with the first aspect is to provide an improved drying section and an improved smoothing apparatus, in which the previously named disadvantages have been eliminated. In this connection, it should in particular also be ensured that maintenance and service work on the smoothing device inside the drying section can be carried out as efficiently as possible and without disturbing the operation of the relevant manufacturing machines, with in particular such a design of the smoothing apparatus being aimed at that this can be ideally employed in a drying section.

In accordance with the invention according to the first aspect, this object is satisfied by a drying section of a machine for the manufacture of a material web, in particular of a paper web or of a board web, comprising a smoothing nip which is extended in the web running direction and formed between two pressing surfaces lying opposite one another of which at least one is formed by a shoe roll, with at least 70%, and preferably at least 90%, of the outer diameter of the shoe roll lying above the machine base.

A problem-free use in a drying section of a shoe roll serving for the formation of an extended smoothing nip is possible on the basis of this design, with the circumstance also in particular being taken into account that, with the use of such a shoe roll, unlike a drying cylinder, the jacket has to be changed from time to time. Such a change is possible without the risk of damaging the jacket in view of the design in accordance with the invention. In addition, the change can take place relatively quickly, whereby the relevant down times of the manufacturing machine, in particular of a paper making machine, are kept as short as possible. Service work can accordingly also be carried out relatively simply. A respective assembly or dismantling of the jacket of the shoe roll cannot only be carried out relatively quickly, but also with a low apparatus effort. This applies in particular when, in accordance with a preferred embodiment of the drying section in accordance with the invention, the shoe roll lies completely above the machine base. The economic advantages resulting for the operation of the relevant paper making machine are substantial. For instance, as already mentioned, shorter down times are achieved. Advantageously, spacers can be used between the bearing of the shoe roll and a respective bearing block and/or cantilever elements can be used. The use of spacers and/or cantilever elements is of particular advantage in connection with the present invention. The jacket can be assembled and/or dismantled with the use of a running-in apparatus. This device can simultaneously serve as a lever for the unilateral raising of the shoe roll, e.g. by the overhead crane. This allows the removal of a spacer between the bearing and the bearing block and thus the threading and pushing of the jacket over the shoe of the shoe roll. On cantilevering, the shoe roll is raised by the introduction of a bending moment on the opposite side such that the spacers can be removed without raising on the operator side.

In certain cases, it can also be of advantage for both pressing surfaces to each be formed by a shoe unit or shoe roll.

At least one of the two pressing surfaces is advantageously heated, with preferably at least one of the two pressing surfacing being provided as a heated smoothing surface.

In accordance with a preferred embodiment of the drying section in accordance with the invention, the shoe roll is insulated with respect to the environment by a hood with simultaneous inner cooling, e.g. by means of the lubricating oil. An insulation of the whole shoe roll against the hot, damp environment is thus possible, for example, with a hood with simultaneous inner cooling, e.g. by means of the lubricating oil. The relevant elements are therefore designed such that their function is not impaired by the high temperature in a respective drying hood due to the large temperature differences between stoppage and operation.

Alternatively or additionally, however, there is also the possibility of cooling the shoe roll preferably provided with a hood with cooling air from the inside and/or from the outside.

It is also of advantage for a damping device to be provided in front of the extended smoothing nip in the web running direction for the sectional influencing of the web moisture transversely to the web running direction.

The extended smoothing nip can be arranged in a single-row, or in a two-row, drying group.

The smoothing apparatus in accordance with the first aspect of the invention includes a smoothing nip which is extended in the web running direction and is formed between two pressing surfaces lying opposite one another of which at least one is formed by a shoe roll of which at least one is heated, with one of the two pressing surfaces preferably being formed by a shoe roll and the other being formed by a drying cylinder, with preferably at least one of the two pressing surfaces being provided as a heated smoothing surface.

A smoothing apparatus is thus proposed in accordance with the invention which is suited in a special manner for use in a drying section.

If the smoothing nip is formed between a shoe roll and a drying cylinder, the drying cylinder preferably has an increased bending moment in comparison with a conventional drying cylinder.

In this connection, the drying cylinder can, for example, have an outer diameter >1.5 m, in particular >1.8 m, in particular 2 m, and preferably >2.4 m, and/or a ribbed inner peripheral surface, in order to increase the bending moment.

It is also of advantage for the drying cylinder to be deflection controlled. In particular, such a deflection control can be provided as is the case with shoe presses.

Advantageously, at least one of the two pressing surfaces is heated, with it having a surface temperature of >40° C., preferably >60° C.

The smoothing nip, or the relevant thickness calender, can be arranged, for example, within a wire loop. Generally, however, an arrangement is also feasible outside such a wire loop.

The flexible jacket of the shoe roll is advantageously temperature resistant up to approximately 120° C., with this jacket preferably consisting of a correspondingly thermally loadable plastic.

The flexible jacket of the shoe roll can in particular consist of elastomeric material on a polymer base, e.g. of polyurethane. The respective jacket armoring preferably consists of elastomeric material whose modulus of elasticity is larger than the modulus of elasticity of the elastomeric material.

The oil used for lubrication in the shoe roll is preferably temperature resistant up to approximately 120° C. The quality of the oil used can therefore in particular be chosen such that temperatures up to 120° C. do not result in any change in the quality such as in the viscosity. The oil and the elastomeric jacket material are advantageously matched to one another.

The outer diameter of the jacket of the shoe roll is preferably ≦1.8 m. The respective space conditions are thus taken into account in an ideal manner, with respective air flows not being hindered and the climate accordingly not being negatively influenced.

In a preferred practical embodiment of the apparatus in accordance with the invention, the shoe roll includes a centrally fixed shoe so that thermal expansion is possible to both sides.

The shoe of the shoe roll can in particular be cooled by the relevant lubricating oil, whereby a thermal expansion of the shoe is reduced or prevented. Generally, cooling from the inside with cooling air is admittedly possible, but cooling by means of lubricating oil is as a rule safer, simpler and more effective.

It is also of advantage for the shoe roll to be provided with means to eliminate the friction between the shoe and the associated pressing unit occurring due to thermal expansion, with the use of hydrostatic pressing pistons, slide elements or a pressing unit being feasible, for example, such as in the case of the commercially available "FlexoNip".

The shoe of the shoe roll can advantageously be loaded or pressed sectionally in the transverse direction and/or web running direction. A smoothing profiling is thus possible, for example, in the transverse direction.

The shoe roll is advantageously insulated with respect to the environment by a hood with simultaneous inner cooling, e.g. by means of the lubricating oil. Insulation of the whole shoe roll with respect to the hot, humid environment is thus possible, for example, using a hood with simultaneous inner cooling, e.g. by means of the lubricating oil. Alternatively or additionally, however, there is also the possibility of cooling a shoe unit provided in each case with a hood by means of cooling air from the inside and/or from the outside.

It is also of advantage for a hood to be associated with the shoe roll, said hood being able to be opened upwardly and to the sides at least so far that the opening created is dimensioned to be at least as large as the outer diameter of the shoe roll and preferably to be dimensioned 1.5 times to 2 times larger than the outer diameter of the shoe roll.

It is thereby ensured that service work can be carried out at the shoe roll—such as a scraper replacement and/or the like—during operation, without disturbing the climate in the hood and thus the production process.

A further important aspect of the invention relates to the design of the shoe roll and/or of the drying cylinder at the respective edges. For instance, the problem occurs in the operation of a shoe roll inside a drying section that the hot surface of the drying cylinder, in particular at the edges not covered with paper, heats up the jacket of the shoe roll consisting preferably of plastic to an impermissible degree by radiation, whereby the service life of said jacket is reduced. A remedy is possible, on the one hand, in that the jacket material is manufactured from a thermally loadable plastic. In accordance with a further preferred practical embodiment of the apparatus in accordance with the invention, the edge regions of the two pressing surfaces not covered by the material web have, on the other hand, a spacing from one another in particular in the smoothing nip plane.

It is here in particular of advantage for the drying cylinder to be shaped conically at the edges and/or for the stroke of the shoe associated with the shoe roll to be dimensioned such that a spacing results to the oppositely disposed pressing surface at the outer edges of the rotating belt which is >5 mm, in particular >8 mm and preferably >12 mm.

It is, for example, also possible to design the drying cylinder in stages.

In accordance with a second aspect, the invention relates to a method for the combined drying and smoothing of a material web, in particular of a paper web or of a board web, in a drying section and, furthermore, to a corresponding smoothing apparatus and to a drying section comprising such a smoothing apparatus.

Methods and apparatuses of the kind just named are known, for example, from the publications DE 195 48 307 A1, DE 196 04 675 C2, DE 44 07 405 C2 and from F. Müller: "Die Papierfabrikation und deren Maschinen II", (Paper Fabrication and its Machinery II) Deutsche Presse, 1928.

As already mentioned, in the previously usual smoothing apparatuses provided in the drying section, the smoothing nips are formed by roll pairs. With fast-running paper making machines, the residence time of the material web in the smoothing nip is too short with thickness calenders of this kind so that no sufficient smoothness can be produced. A further disadvantage consists of the fact that the pressure increase, or the pressure gradient, adopted in the roll nip is too large, which can result in damage to the paper web. In addition, the shape of the smoothing pressure profile in the running direction of the machine or of the web cannot be chosen as desired, but is dependent on the roll diameters. However, it is often necessary to change the pressure profile in the machine running direction of different types of paper. An optimum smoothing result, without a negative influencing of the remaining paper quality parameters, is not possible without such a matching of the pressure profile. With these conventional methods and apparatuses, moreover, no influencing of the smoothing transverse profile is possible, either. Moreover, the smoothness which can be achieved is insufficient, in particular with faster paper making machines.

An aim of the invention in accordance with the second aspect is to provide an improved method, an improved smoothing apparatus and an improved drying section of the kind previously named in which the previously named disadvantages have been eliminated.

In accordance with the invention in accordance with the second aspect, this object is satisfied by a method for the combined drying and smoothing of a material web, in particular of a paper web or of a board web, in a drying section, in which the material web is first dried to a pre-settable drying content >60%, in particular >65%, and preferably >70%;

the material web having this pre-settable drying content is led through a smoothing nip which is extended in the web running direction and is formed between two pressing surfaces lying opposite one another of which at least one is formed by a rotating belt and of which at least one is heated;

the pressing time resulting in the extended smoothing nip is selected as >0.8 ms; and the material web is further dried after the smoothing nip.

The smoothing nip is therefore provided at such a position in the drying section at which the main shrinking process has already begun so that the smoothness is maintained and does not deteriorate due to shrinking processes. The surface of the material web is actually made rougher again by shrinking.

In this connection, at least one of the two pressing surfaces is formed by a shoe unit, which can in particular be a shoe roll. In the case of a shoe roll, its flexible jacket forms the relevant rotating belt.

For at least one of the two pressing surfaces, the value $R_a$ (average peak-to-valley height) is advantageously <4 μm and preferably <3 μm.

The two pressing surfaces can have a different smoothness or also the same smoothness.

It is also of advantage if at least one of the two pressing surfaces is provided as a heated smoothing surface.

A damping device can be used in front of the extended press nip in the web running direction for the sectional influencing of the web moisture transversely to the web running direction.

The extended smoothing nip can be provided in a single-row drying section or drying group or also in a two-row drying section or drying group.

The smoothing device in accordance with the second aspect of the invention includes a smoothing nip which is extended in the web running direction and is formed between two pressing surfaces lying opposite one another of which at least one is formed by a rotating belt and of which at least one is heated.

The smoothing apparatus is suitable in a particular manner for use in the drying section on the basis of this design.

In accordance with a preferred embodiment of the smoothing apparatus in accordance with the invention, at least one of the two pressing surfaces is formed by a shoe unit, which can again in particular be a shoe roll, with the relevant rotating belt being formed by its flexible jacket.

The two pressing surfaces can again have a different smoothness or the same smoothness.

At least one of the two pressing surfaces is advantageously provided as a heated smoothing surface.

A damping device can again be provided in front of the extended smoothing nip in the web running direction for the sectional influencing of the web moisture transversely to the web running direction.

In a preferred practical embodiment of the apparatus in accordance with the invention, one of the two pressing surfaces is formed by a rotating belt or by a shoe unit and the other is formed by a drying cylinder. The drying cylinder preferably has an increased bending moment in comparison with a conventional drying cylinder, To increase the bending moment, the drying cylinder can, for example, have an outer diameter >1.5 m, in particular >1.8 m, and preferably >2 m, and/or a ribbed inner peripheral surface.

The drying cylinder is preferably deflection controlled. In particular, such a deflection control can be provided as is the case with shoe presses.

Advantageously, at least one of the two pressing surfaces is heated, with it having a surface temperature >40° C., preferably >60° C.

The machine speed, or the web running speed, can in particular be >450 m/min and preferably >1200 m/min.

In an expedient practical embodiment of the apparatus in accordance with the invention, the web residence time in the smoothing gap is >0.8 msec, in particular >2 msec, and preferably >4 msec, and/or the shoe length measured in the web running direction is >30 mm and preferably >60 mm.

The smoothing nip or the relevant thickness calender can be arranged, for example, within a wire loop. Generally, however, an arrangement is also feasible outside such a wire loop.

At least one of the two pressing surfaces is advantageously formed by a rotating belt which is temperature resistant up to approximately 120° C., with this belt preferably consisting of a correspondingly thermally loadable plastic. The rotating belt can, for example, be the flexible belt of a shoe unit, e.g. the flexible jacket of a shoe roll.

The flexible belt can in particular consist of elastomeric material on a polymer base, e.g. of polyurethane.

In this connection, the belt armoring preferably consists of elastomeric material whose modulus of elasticity is larger than the modulus of elasticity of the elastomeric belt material.

The oil used for lubrication in the respective shoe roll is preferably temperature resistant up to approximately 120° C. The quality of the oil used can therefore in particular be chosen such that temperatures up to 120° C. do not result in any change in the quality such as in the viscosity. The oil and the elastomeric belt material are preferably matched to one another.

If the rotating belt is formed by the flexible jacket of a shoe roll, its outer diameter is preferably ≦1.8 m. The respective space conditions are thus taken into account in an ideal manner, with respective air flows not being hindered and the climate accordingly not being negatively influenced.

If one of the two pressing surfaces is formed by a shoe roll and the other by a drying cylinder, then the outer diameter of the shoe roll is preferably smaller than or equal to the outer diameter of the drying cylinder.

A central fixing of the respective shoe is also of advantage, whereby a thermal expansion to both sides is possible.

The shoe of a respective shoe roll can in particular be cooled by the relevant lubricating oil, whereby a thermal expansion of the shoe is reduced or prevented. Generally, cooling from the inside with cooling air is admittedly possible, but cooling by means of lubricating oil is as a rule safer, simpler and more effective.

The shoe unit is expediently provided with means to eliminate the friction between the shoe and the associated pressing unit occurring due to thermal expansion, with the use of hydrostatic pressing pistons, sliding elements or a pressing unit being feasible, for example, such as in the case of the commercially available "FlexoNip".

In a preferred practical embodiment of the apparatus in accordance with the invention, the shoe unit includes a show sectioned in the transverse direction, via which the smoothness can be sectionally influenced in the transverse direction, i.e. transverse to the machine running direction or to the web running direction. The smoothness can therefore be profiled in the transverse direction.

The shoe unit is advantageously insulated toward the environment by a hood with simultaneous inner cooling, e.g. by means of the lubricating oil. Insulation of the whole shoe roll with respect to the hot, humid environment is thus possible, for example, using a hood with simultaneous inner cooling, e.g. by means of the lubricating oil.

Alternatively or additionally, however, there is also the possibility of cooling a shoe unit provided in each case with a hood by means of cooling air from the inside and/or from the outside.

A further important aspect of the invention again relates to the design of the shoe unit or of the shoe roll and/or of the drying cylinder at the respective edges. For instance, the problem occurs in the operation of a shoe roll inside a drying section, for example, that the hot surface of the drying cylinder, in particular at the edges not covered with paper, heats up the jacket of the shoe roll consisting preferably of plastic to an impermissible degree by radiation, whereby the service life of said jacket is reduced. A remedy is possible, on the one hand, in that the jacket material is manufactured from a thermally loadable plastic. In accordance with a further preferred practical embodiment of the apparatus in accordance with the invention, the edge regions of the two pressing surfaces not covered by the material web have, on the other hand, a spacing from one another in particular in the smoothing nip plane. It is here in particular of advantage for the drying cylinder to be shaped conically at the edges and/or for the stroke of the shoe associated with the shoe unit to be dimensioned such that a spacing results with respect to the oppositely disposed pressing surface at the outer edges of the rotating belt which is >5 mm, in particular >8 mm and preferably >12 mm. It is, for example, also possible to design the drying cylinder in stages.

In certain cases, it is of advantage for the drying cylinder, or the smoothing cylinder, to be heated from the outside, e.g. electrically, by steam and/or the like.

In an expedient practical embodiment of the apparatus in accordance with the invention, the drying cylinder, or the smoothing cylinder, is sectionally heatable considered in the transverse direction, whereby the sectional moisture of the material can be correspondingly influenced such that the smoothness profile can be correspondingly controlled and/or regulated. This is particularly effective with a dry content >60%.

If is also of advantage for the hood associated with the shoe roll to be able to be opened upwardly and to the sides at least so far that the opening created is dimensioned at least as large as the outer diameter of the shoe roll and preferably to be dimensioned 1.5 times to 2 times larger than the outer diameter of the shoe roll. It is thereby ensured that service work can be carried out at the shoe roll—such as a scraper replacement and/or the like—during operation, without disturbing the climate in the hood and thus the production process.

In accordance with the invention, a drying section of a machine for the manufacture of a material web, in particular of a paper web or of a board web, is further proposed, comprising a smoothing apparatus in accordance with the second aspect of the invention.

A further important aspect of the invention relates to the arrangement of the shoe roll in the drying section. For instance, in accordance with a preferred practical embodiment of the drying section in accordance with the invention, provision is made that at least 70%, and preferably at least 90%, of the outer shoe roll diameter lies above the machine base. In this connection, the shoe roll can in particular also lie fully above the machine base. This provides the advantage that a respective assembly or dismantling of the jacket of the shoe roll can be carried out rapidly and with a low apparatus effort. The economic advantages resulting for the operation of the relevant paper making machine are substantial. For instance, first, shorter down times are achieved. Advantageously, spacers can be used between the bearing of the shoe unit roll and a respective bearing block and/or cantilever elements can be used. The use of spacers and/or cantilever elements is of particular advantage in connection with the present invention. The jacket can be assembled and/or dismantled with the use of a running-in apparatus. This device can simultaneously serve as a lever for the unilateral raising of the shoe roll, e.g. by the overhead crane. This allows the removal of a spacer between the bearing and the bearing block and thus the threading and pushing of the jacket over the shoe of the shoe roll. On cantilevering, the shoe roll is raised by the introduction of a bending element at the opposite side such that the spacers can be removed without raising on the operator side.

In accordance with the invention, a commercial and technologically improved solution is set forth for the smoothing of a material web, such as in particular a paper web or a board web, which is in particular also suitable for higher machine speeds.

Any desired combinations of the two aspects of the invention are possible.

Figure 2:
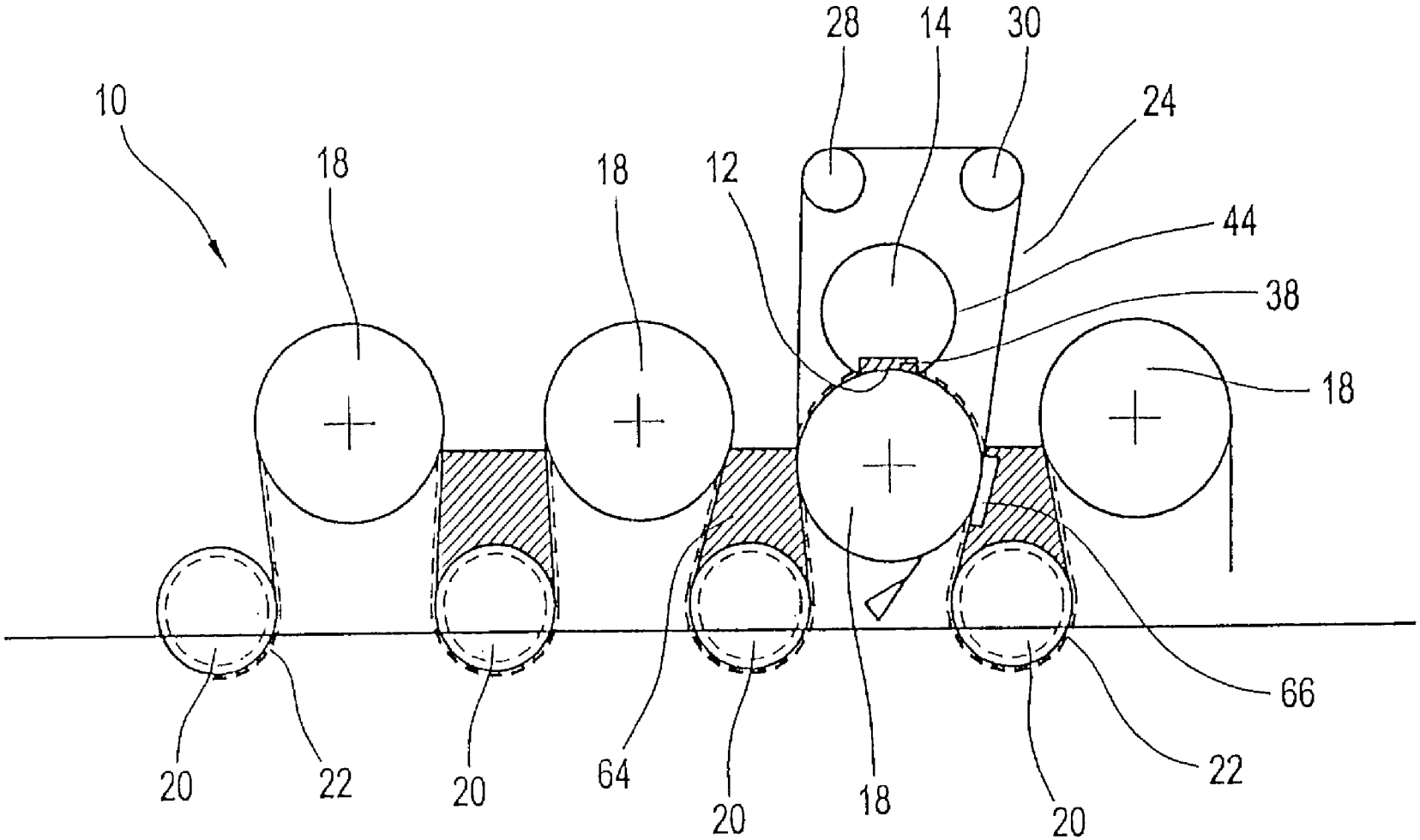
Figure 3:
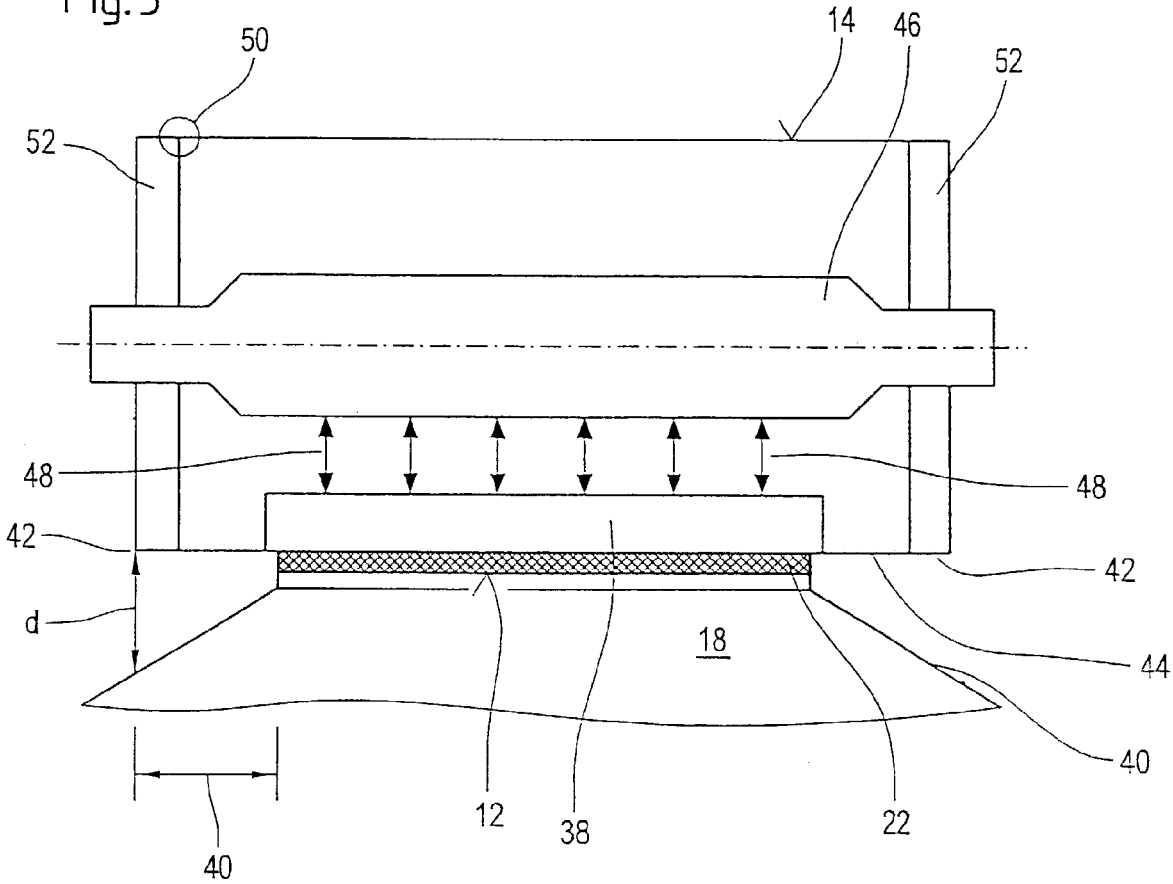
Figure 4:
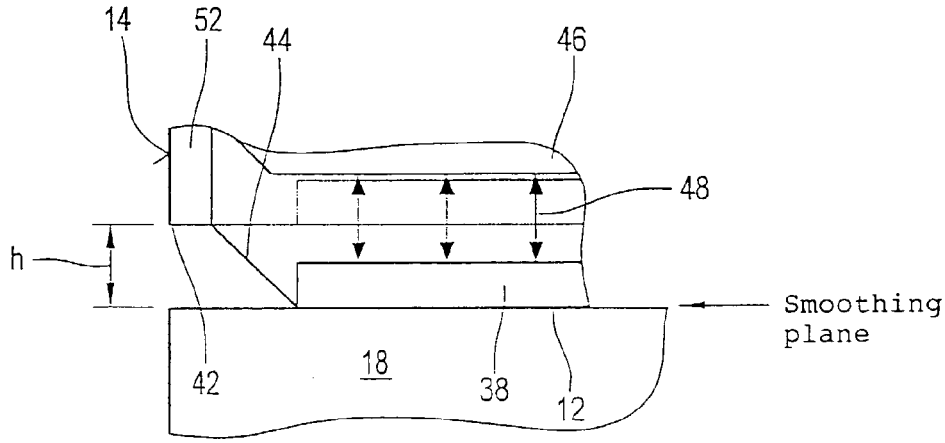
Figure 5:
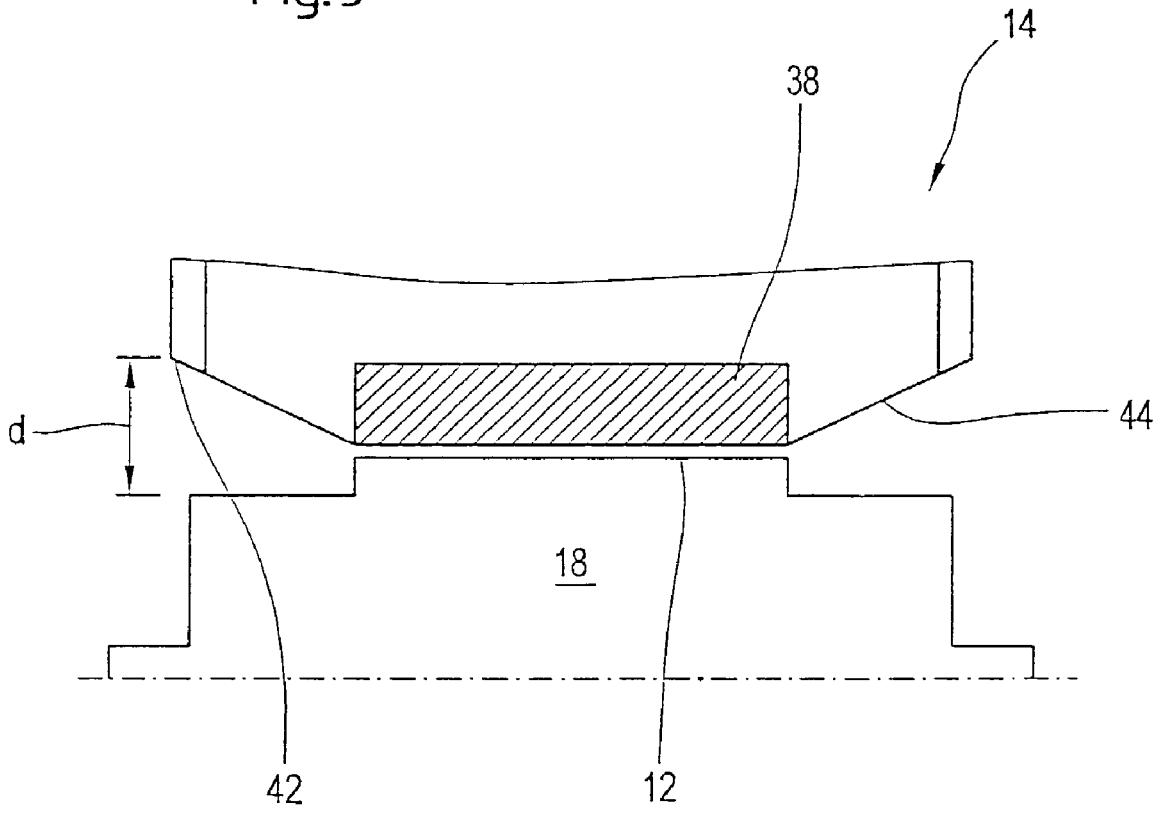
Figure 6:
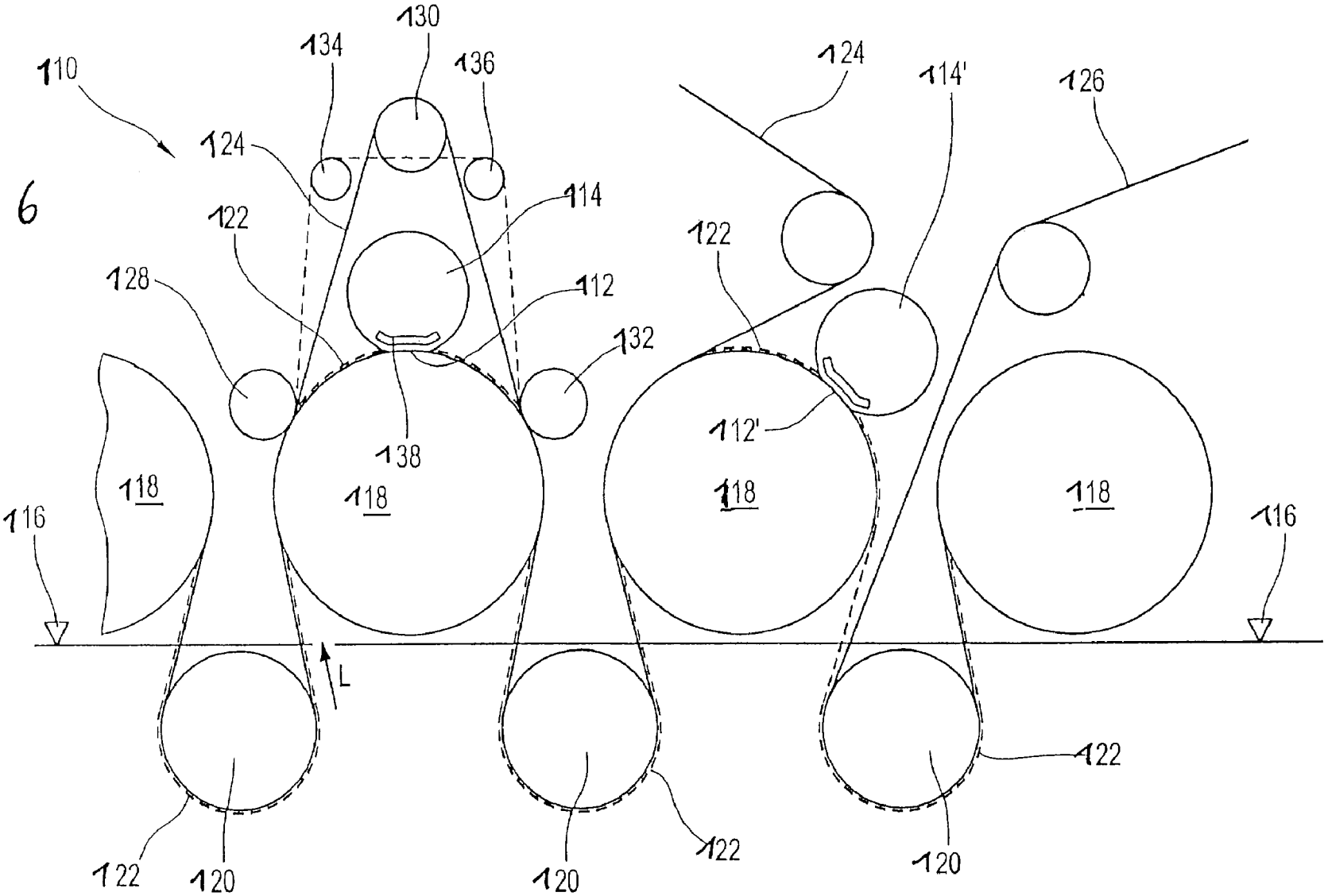
Figure 7:
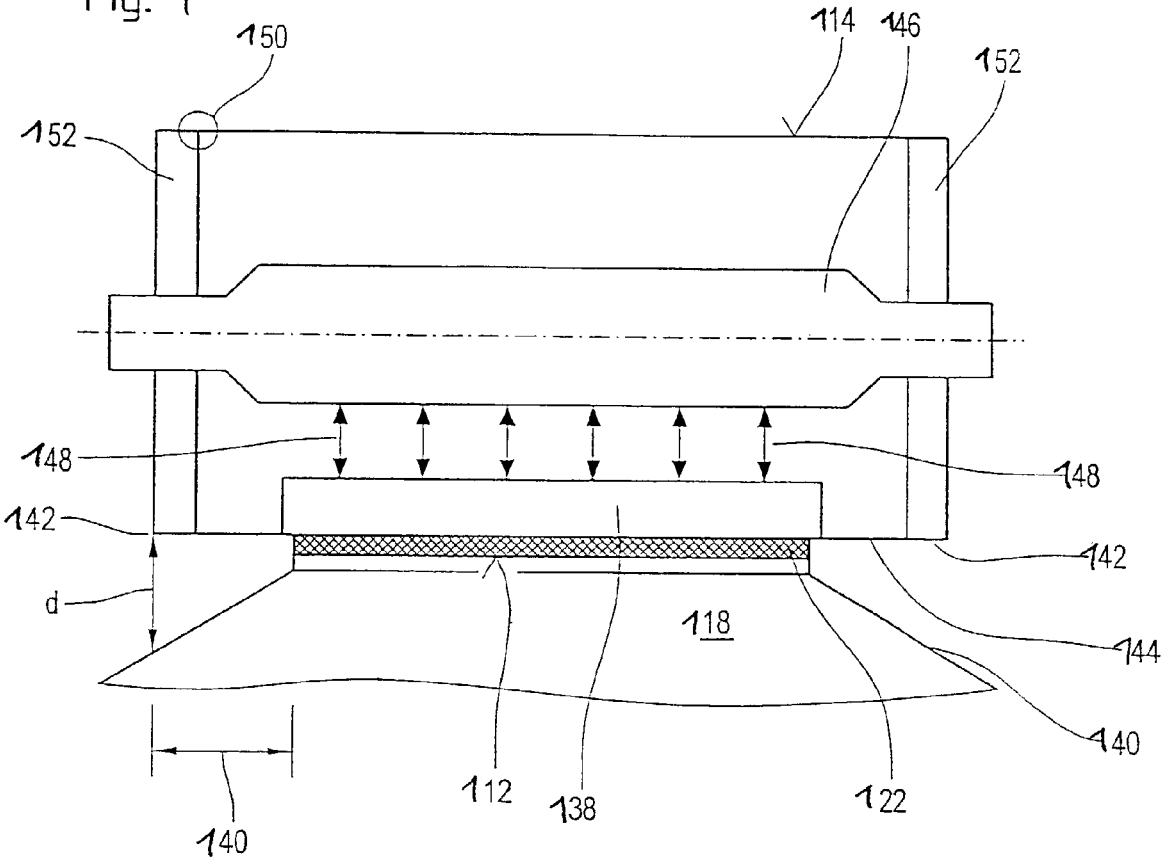
Figure 8:
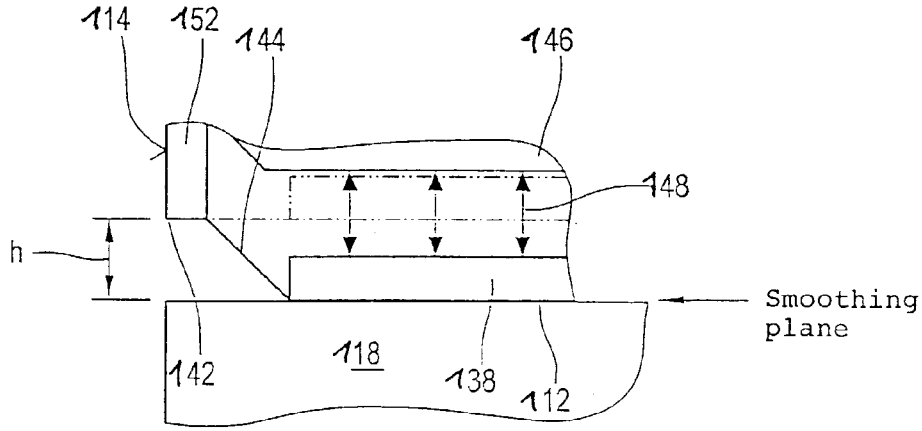
Figure 9:
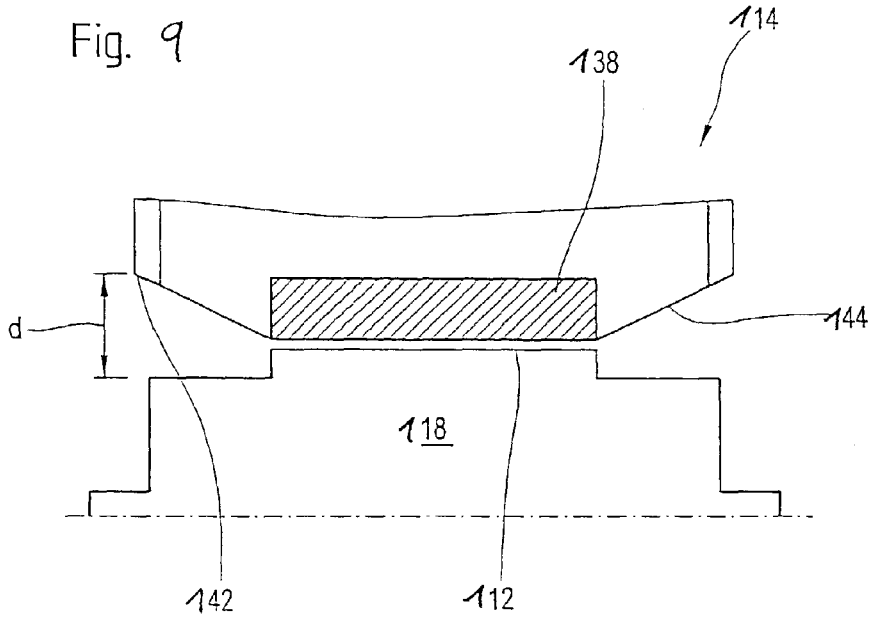
Figure 10:
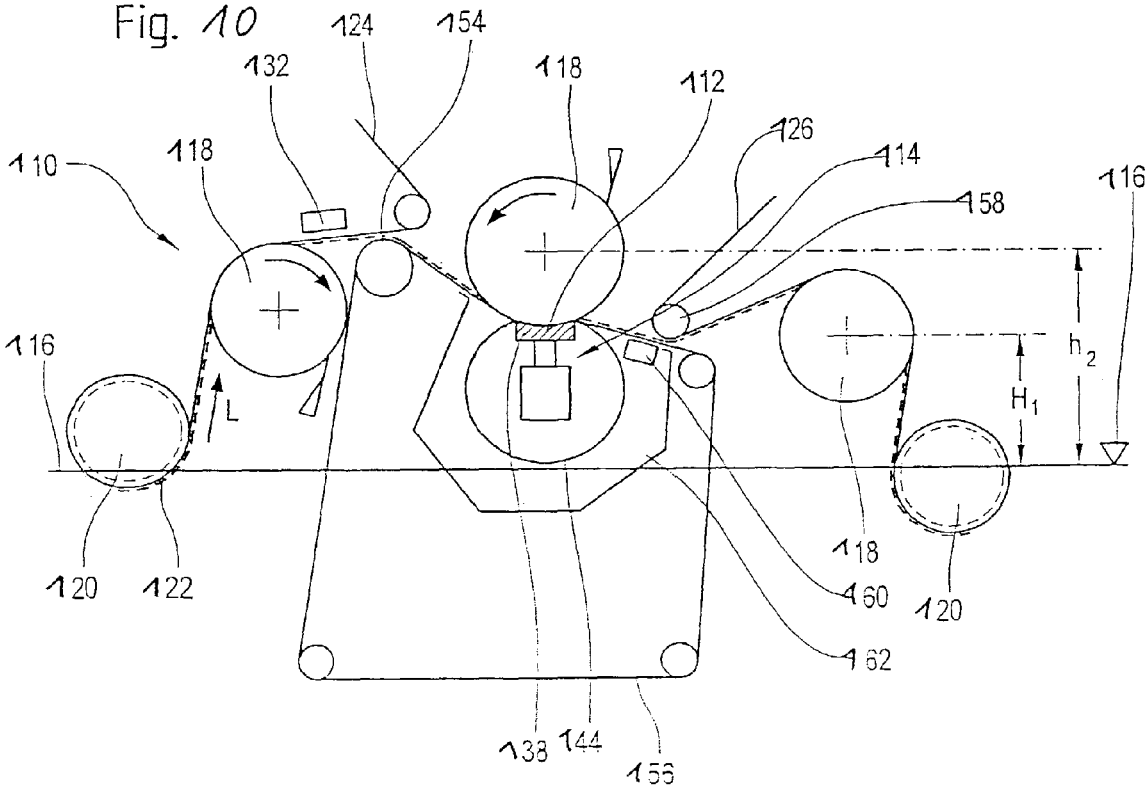
Figure 11:
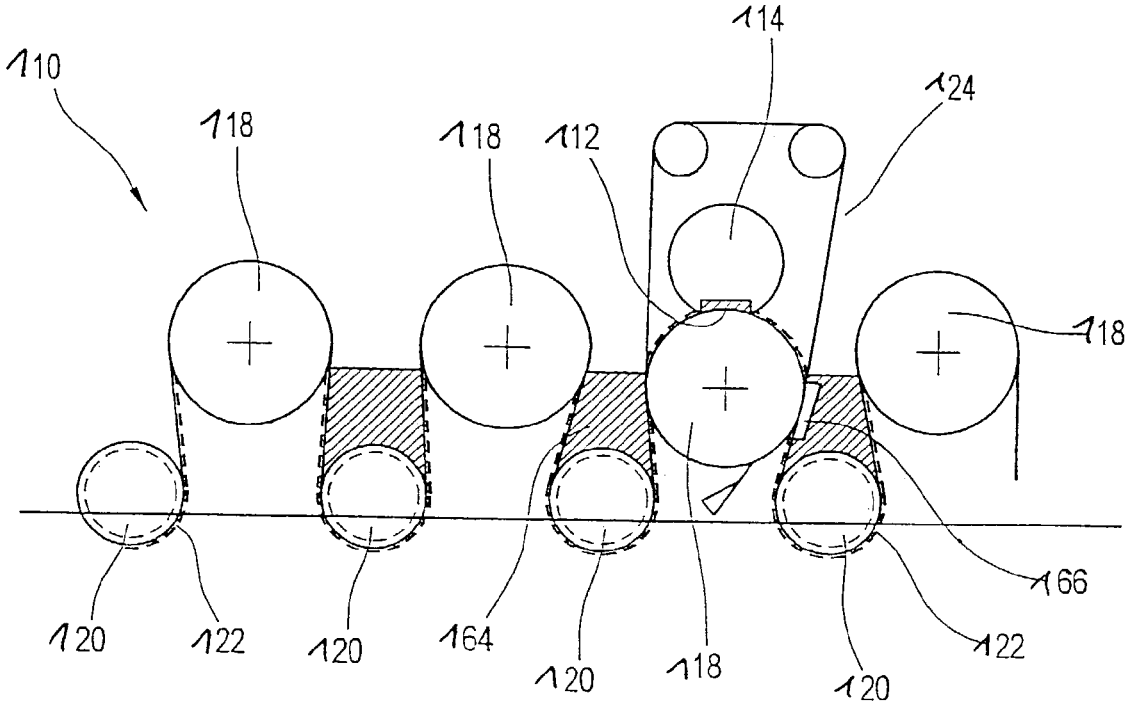
Figure 12:
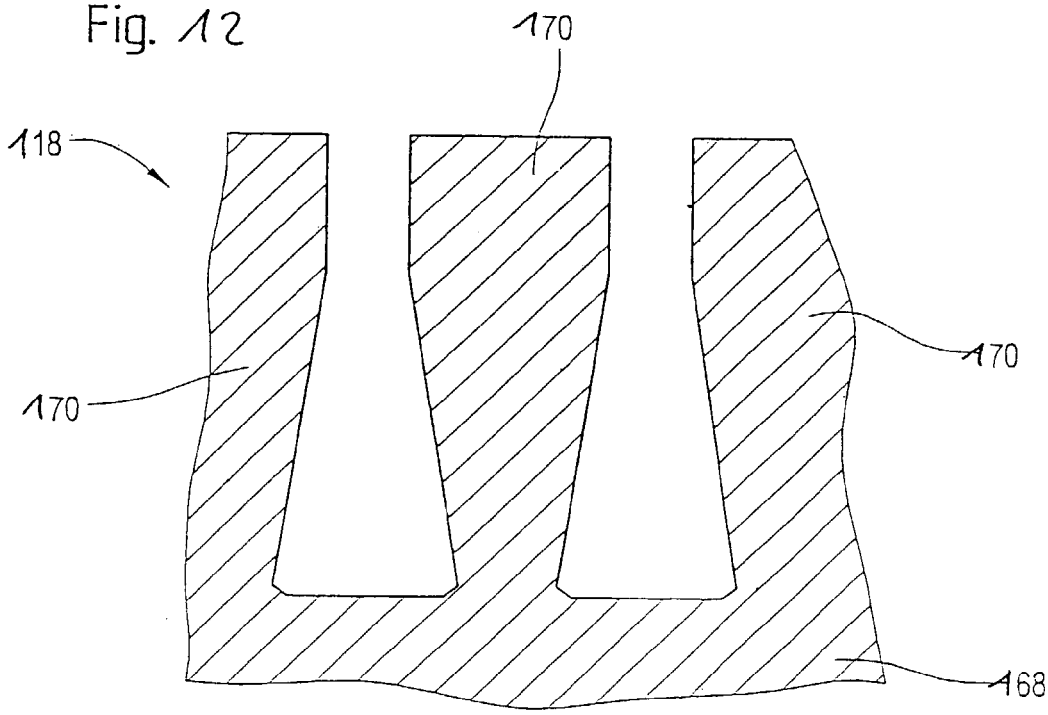

The invention will be described in more detail in the following with reference to embodiments and to the drawing, with the embodiments of FIGS. 1 to 5 primarily relating to the first aspect and FIGS. 6 to 12 primarily relating to the second aspect of the invention. There are shown:

FIG. 1 a schematic part representation of a single-row drying section comprising a shoe roll which forms a smoothing nip with a drying cylinder arranged above it;

FIG. 2 a schematic part view of a single-row drying section comprising a shoe roll which forms a smoothing nip with a drying cylinder arranged below it;

FIG. 3 a schematic longitudinally sectioned part representation of an exemplary embodiment of a thickness calender including a shoe roll and a drying cylinder, in which the drying cylinder is conically shaped at the edges;

FIG. 4 a schematic longitudinally sectioned part representation of an exemplary embodiment of a thickness calender including a shoe roll and a drying cylinder, in which the stroke of the shoe is dimensioned such that a spacing results to the oppositely disposed drying cylinder at the outer edges of the shoe roll jacket;

FIG. 5 a schematic longitudinally sectioned part representation of an exemplary embodiment of a thickness calender including a shoe roll and a drying cylinder, in which the drying cylinder is designed in stages;

FIG. 6 a schematic part representation of a drying section in which two possible arrangements of a shoe roller serving for the formation of an extended smoothing nip are shown purely by way of example;

FIG. 7 a schematic longitudinally sectioned part representation of an exemplary embodiment of a thickness calender including a shoe roll and a drying cylinder, in which the drying cylinder is conically shaped at the edges;

FIG. 8 a schematic longitudinally sectioned part representation of an exemplary embodiment of a thickness calender including a shoe roll and a drying cylinder, in which the stroke of the shoe is dimensioned such that a spacing results to the drying cylinder lying opposite at the outer edges of the shoe roll jacket;

FIG. 9 a schematic longitudinally sectioned part representation of an exemplary embodiment of a thickness calender including a shoe roll and a drying cylinder, in which the drying cylinder is designed in stages;

FIG. 10 a schematic part representation of a single-row drying section comprising a shoe roller which forms a smoothing nip with a drying cylinder arranged above it;

FIG. 11 a schematic part view of a single-row drying section comprising a shoe roll which forms a smoothing nip with a drying cylinder arranged below it;

FIG. 12 a sectioned part representation of a drying cylinder provided with a ribbed inner peripheral surface.

FIGS. 1 and 2 respectively show, in a purely schematic part representation, a drying section 10 comprising a respective smoothing nip 12 extended in the web running direction L, with two possible arrangements of a shoe roll 14 serving for the formation of such an extended smoothing nip 12 being shown purely by way of example.

The respective drying section 10 can in particular be associated with a machine for the manufacture of a material web, in particular of a paper web and/or of a board web. The respective drying section 10 can therefore in particular be part of a paper making machine.

FIGS. 1 and 2 respectively show a section of a single-row drying section 10 or of a single-row drying group with drying cylinders 18 arranged above the paper making machine base 16. Web guiding rolls 20 are provided beneath the drying cylinders 18 and, in the present embodiment, can at least in part also be arranged beneath the paper making machine base 16.

The material web 22 is guided, together with a respective conveyor belt, here drying wire 24 or 26 respectively, at least sectionally around the drying cylinders 18 and the web guiding rolls 20 in a meandering manner, with the web guiding rolls 20 being arranged at such a spacing from the drying cylinders 18 that free running stretches result for the material web 22 and the respective drying wire 24 or 26 between the drying cylinders 18 and the web guiding rolls 20.

The respective smoothing nip 12 extended in the web running direction L is respectively formed between a shoe roll 14 and a drying cylinder 18, with the shoe roll 14 being arranged directly beneath the relevant drying cylinder 18 in one case (cf. FIG. 1), whereas it is arranged directly above the drying cylinder in the other case (cf. FIG. 2).

While the shoe roll 14 is provided outside the wire loops in the embodiment in accordance with FIG. 1, it is arranged inside the loop of the drying wire 24 in the embodiment shown in FIG. 2. The relevant loop is formed here, for example, in that the drying wire 24 is guided over at least one additional web guiding roll 28, 30 in the relevant region.

It is thus common to the two embodiments shown in FIGS. 1 and 2 that, inside the drying section 10, at least one respective smoothing nip 12 extended in the web running direction L is provided which is formed between two pressing surfaces lying opposite one another, of which at least one is formed by a shoe roll 14, with at least 70%, and preferably at least 90%, of the outer shoe roll diameter respectively lying above the machine base 16. In the two embodiments shown, the shoe roll 14 lies in each case completely above the machine base 16.

The respective shoe roll 14 includes at least one shoe 38, over which the flexible roll jacket 44 can be pressed toward the opposite drying cylinder 18 while forming the relevant extended press nip or press gap 12.

FIG. 1 shows, in a schematic part representation, a single-row drying section 10 comprising a shoe roll 14 which has a flexible jacket 44 and which forms a smoothing nip 12 extended in the web running direction L together with a drying cylinder 18 arranged above it, with the drying cylinder 18 lying opposite the shoe roll 14 being set higher than the remaining drying cylinders 18. For instance, in this embodiment in accordance with FIG. 1, the axis of the drying cylinder 18 lying opposite the shoe roll 14 lies at a height $h_2$ above the machine base 16 which is larger than the height hi at which the remaining drying cylinders 18 are arranged.

In the present case, not only the relevant drying cylinder 18 is arranged completely above the machine base 16, but also the shoe roll 14 arranged beneath it.

A problem-free jacket replacement is thus possible despite the arrangement of the shoe roll 14 beneath the relevant drying cylinder 18.

As can be recognized with reference to this FIG. 1, a suction box 32 is provided subsequent to the first drying cylinder 18 to be recognized within the loop of the relevant drying wire 24. Subsequent to this, the material web 22 is taken over from the drying wire 24 in the region of a deflection roll 44 by a conveyor belt 56, e.g. a drying wire or a smoothing belt, and is guided together with the conveyor belt 26 through the smoothing nip 12 extended in the web running direction L.

The material web 22 is taken from the conveyor belt 26 in the region of a deflection roll 28 by a drying wire 26 behind the extended smoothing nip 12 and is supplied together with this drying wire 26 to the succeeding drying cylinder 18.

A suction box 60 is provided behind the extended smoothing nip 12 inside the loop of the conveyor belt 56. A hood 62, for example an air cooled hood, is provided around the shoe roll 14 provided beneath the relevant drying cylinder 18 and inside the loop of the conveyor belt 56.

The cylinder 18 arranged above the shoe roll 14 is heated and serves as a smoothing cylinder.

The web guiding or deflection rolls 20, which are exposed to suction, have a smaller diameter than the drying cylinders 18.

As already mentioned, FIG. 2 shows, in a schematic part representation, an embodiment of a single-row drying section in which the shoe roll 14 forms the smoothing nip 12 extended in the web running direction L together with a drying cylinder 18 arranged beneath it.

As can be seen with reference to this FIG. 2, the drying cylinder 18 arranged beneath the shoe roll 14 is somewhat lower than the adjacent drying cylinder 18.

The cylinder 18 forming the extended smoothing nip 12 with the shoe roll 14 is therefore also again heated and provided as a smoothing cylinder here.

Web stabilizers 64 are provided in the region of the web guiding rollers 20 lying lower than the cylinders 18.

In the present case, the shoe roll 14 is arranged inside the loop of the drying wire 24.

A high vacuum zone 66 is provided in the region of the drying or smoothing cylinder 18 provided beneath the shoe roll 14.

FIG. 3 shows, in a schematic longitudinally sectioned part representation, an exemplary embodiment of a thickness calender including a shoe roll 14 and a drying cylinder 18 to form a smoothing nip 12 extended in the web running direction. The relevant shoe roll 14 can in particular be used in a drying section.

To prevent the hot surface of the drying cylinder 18 from heating the jacket of the shoe roll 14, which preferably consists of plastic, to an impermissible degree at the edges 40 not covered by paper by radiation, the arrangement is made such that the edge regions of the two pressing surfaces not covered by the material web 22 have a spacing to one another, in particular in the plane of the smoothing nip.

In the present case, the drying cylinder 18 is conically shaped at the edges 40 such that a spacing d results at the outer edges 42 of the rotating flexible jacket, i.e. here therefore of the jacket 44 of the shoe roll 14, to the smoothing surface lying opposite, i.e. to the surface of the drying cylinder 18, which is expediently >5 mm, in particular >8 mm, and preferably >12 mm.

The basic design of the relevant shoe roll 14 can also be recognized again with reference to this FIG. 3. Accordingly, this shoe roll 14 includes a flexible jacket 44 which rotates about a rotationally fixed yoke 46 and which can be pressed toward the relevant drying cylinder 18 by at least one shoe 38. The shoe 38 is loaded by a plurality of supporting elements, 48, e.g. hydraulic supporting elements, supported at the yoke 46. These supporting elements 48 can, for example, be hydraulic piston-in-cylinder arrangements. The flexible jacket 44 is fixed in each case to end plates 52 by means of a respective jacket fixing 50.

FIG. 4 shows, in a schematic longitudinally sectioned part representation, another exemplary embodiment of a thickness calender including a shoe roll 14 and a drying cylinder 18 to form a smoothing nip 12 extended in the web running direction.

In this case, the stroke h of the shoe 38 is dimensioned such that the desired spacing d results at the outer edges 42 of the shoe roll jacket 44.

FIG. 5 shows, again in a schematic longitudinally sectioned part representation, a further exemplary embodiment of a thickness calender including a shoe roll 14 and a drying cylinder 18 to form a smoothing nip extended in the web running direction.

In this case, the drying cylinder 18 is made in stages in order to obtain the desired spacing d to the drying cylinder 18 lying opposite at the outer edges 42 of the shoe roll jacket 44.

FIG. 6 shows, in a purely schematic part representation, a drying section 110 in which two possible arrangements of a shoe roll 114 and 114' serving for the formation of an extended smoothing nip 112 and 112' are shown purely by way of example.

The drying section 110 can in particular be associated with a machine for the manufacture of a material web, in particular of a paper web or of a board web. The drying section 110 can therefore in particular be part of a paper making machine.

FIG. 6 shows a section of the drying section 110 having a row of drying cylinders 118 which are arranged above the paper making machine base 116 and whose axes lie, for example, in one plane. Web guiding rolls 120 are provided beneath the drying cylinders 118 and, in the present embodiment, are arranged at least to a larger extent beneath the paper making machine base 116.

The material web 122 is guided, together with a respective conveyor belt, here a drying wire 124 or 126, in meandering form, at least sectionally, around the drying cylinders 118 and the web guiding rolls 120, with the web guiding rolls 120 being arranged at such a spacing to the drying cylinders 118 that free running stretches result for the material web and the respective drying wire 124 or 126 between the drying cylinders 118 and the web guiding rolls 120.

The smoothing nip 112 extended in the web running direction L is formed between an upwardly disposed shoe roll 114 and a downwardly disposed drying cylinder 118. The shoe roll 114 is here arranged e.g. directly above the relevant drying cylinder 118 (see the left hand part of FIG. 6). Moreover, this shoe roll 114 is provided inside a loop of the drying wire 124. The relevant loop is formed, for example, in that the drying wire 124 is separated from the drying cylinder 118 and the material web 122 continued thereon in the region of a web guiding roll 128 and is subsequently guided over a web guiding roll 130 before it again runs onto the drying cylinder 118 in the region of a further web guiding roll 132, whereby the material web 122 is again pressed onto the drying cylinder 118 by the drying wire 124. Instead of over the one upper web guiding roll 130, the drying wire 124 can, for example, also be guided over two web guiding rolls 134, 136 provided spaced apart from one another, whereby the loop is correspondingly increased in size.

The shoe roll 114' forming the smoothing nip 112' extended in the web running direction L with the relevant drying cylinder 118 is arranged in a region obliquely above the relevant drying cylinder 118 and outside the loops of the two drying wires 124, 126 (cf. the right hand part of FIG. 6).

A combined drying and smoothing of the material web 122 is thus possible, with the material web 122 first being dried to a pre-settable dry content >60%, in particular >65%, and preferably >70%. The material web 122 having this pre-settable dry content is then guided through the respective smoothing nip 112 or 112' which is extended in the web running direction and is formed by two pressing surfaces lying opposite one another of which the one is formed by a rotating flexible belt, here the flexible jacket of the relevant shoe roll 114 or 114', and the other is formed by the relevant heated drying cylinder, with the pressing time resulting in the extended smoothing nip 112 or 112' preferably being chosen as >0.8 ms. The material web 122 is further dried subsequent to the smoothing nip 112 or 112'. The shoe roll 114 or 114' includes at least one shoe 138, over which the flexible roll jacket can be pressed toward the relevant drying cylinder 118 while forming an extended press nip or press gap.

FIG. 7 shows, in a schematic longitudinally sectioned part representation, an exemplary embodiment of a thickness calender including a shoe roll 114 and a drying cylinder 118 to form a smoothing nip 112 extended in the web running direction.

To prevent the hot surface of the drying cylinder 118 from heating the jacket 144 of the shoe roll 114, which preferably consists of plastic, to an impermissible degree at the edges 140 not covered by paper by radiation, the arrangement is made such that the edge regions of the two pressing surfaces not covered by the material web 122 have a spacing from one another, in particular in the smoothing nip plane.

In the present case, the drying cylinder 118 is shaped conically at the edges 140 such that a spacing d results with respect to the smoothing surface lying opposite, i.e. here to the surface of the drying cylinder 118, at the outer edges 142 of the rotating flexible belt, i.e. here therefore of the jacket 144 of the shoe roll 114, which spacing d is expediently >5 mm, in particular >8 mm, and preferably >12 mm.

The general design of the relevant shoe roll 114 can again also be recognized with reference to this FIG. 7. Accordingly, this shoe roll 114 includes a flexible jacket 144 which rotates about a rotationally fixed yoke 146 and which can be pressed over at least one shoe 138 toward the drying cylinder 118. The shoe 138 is acted upon by a plurality of supporting elements 148, e.g. hydraulic supporting elements, supported at the yoke 146. These supporting elements 148 can, for example, be hydraulic piston-in-cylinder arrangements. The flexible jacket 144 is secured to end plates 152 by means of a respective jacket fixing 150.

FIG. 8 shows, in a schematic longitudinally sectioned part representation, another exemplary embodiment of a thickness calender including a shoe roll 144 and a drying cylinder 118 to form a smoothing nip 112 extended in the web running direction.

In this case, the stroke h of the shoe 138 is dimensioned such that the desired spacing d results at the outer edges 142 of the shoe roll jacket 144.

FIG. 9 shows, again in a schematic longitudinally sectioned part representation, a further exemplary embodiment of a thickness calender including a shoe roll 114 and a drying cylinder 188 to form a smoothing nip 112 extended in the web running direction.

In this case, the drying cylinder 118 is made in stages in order to obtain the desired spacing d to the drying cylinder 118 lying opposite at the outer edges 142 of the shoe roll jacket 144.

FIG. 10 shows, in a schematic part representation, a single row drying section 110 comprising a shoe roll 114 which has a flexible jacket 144 and which forms a smoothing nip 112 extended in the web running direction with a drying cylinder 118 arranged thereabove.

As can be recognized with reference to FIG. 10, the drying cylinder 188 lying opposite the shoe roll 144 must be set higher than the remaining drying cylinders. In the embodiment shown, the axis of the drying cylinder lying opposite the shoe roll 114 thus lies at a height $H_2$ above the machine base 116 which is larger than the height $H_1$ at which the remaining drying cylinders 118 are arranged.

In the present case, not only the relevant drying cylinder 118, but rather also the show roll 114 arranged below it, is arranged completely above the machine base 116.

A problem-free jacket replacement is thus possible despite the arrangement of the shoe roll 114 beneath a drying cylinder 118.

As can be recognized with reference to FIG. 10, a suction box 154 is provided subsequent to the first drying cylinder 118 to be recognized inside the loop of the relevant drying wire 124. Subsequent to this, the material web 122 is taken over from the drying sieve 124 in the region of a deflection roll 155 by a conveyor belt 156, e.g. a drying wire or a smoothing belt, and guided together with the conveyor belt 156 through the smoothing nip 112 extended in the web running direction L.

After the extended smoothing nip 112, the material web 122 is taken over from the conveyor belt 156 in the region of a deflection roll 158 by a drying wire 126 and is guided to the succeeding drying cylinder 118 together with this drying wire 126.

A suction box 160 is provided after the extended smoothing nip 112 inside the loop of the conveyor belt 156.

A hood 162, for example an air cooled hood, is provided around the shoe roll 14 provided beneath the relevant drying cylinder 118 and inside the loop of the conveyor belt 156.

The cylinder 118 arranged above the shoe roll 114 is heated and serves as a smoothing cylinder.

The web guiding rolls, or deflection rolls, 120 exposed to suction have a smaller diameter than the cylinders 118.

FIG. 11 shows, in a schematic part representation, a further embodiment of a single-row drying section 110 comprising a shoe roll 14 which forms a smoothing nip 112 extended in the web running direction L together with a drying cylinder 18 arranged therebelow.

As can be recognized with reference to FIG. 11, the drying cylinder 118 arranged beneath the shoe roll 114 lies somewhat lower than the adjacent drying cylinders 118.

The cylinder 118 forming the extended smoothing nip 112 with the shoe roll 114 is therefore again also heated here and provided as a smoothing cylinder.

Web stabilizers 164 are provided in the region of the web guiding rolls 120 lying lower than the cylinders 118 here.

The shoe roll 114 is, in the same way as in the embodiment shown in the left hand part of FIG. 6, again arranged inside the loop of a drying wire 124.

A high vacuum zone 166 is provided in the region of the drying or smoothing cylinder 118 provided beneath the shoe roll 114.

FIG. 12 shows, in a sectioned part representation, a drying cylinder 118 provided with a ribbed inner peripheral surface for use in a corresponding thickness calender having a shoe roll. With the ribs 170 provided on the inside at the jacket 168 of the drying cylinder 118, there results an increased bending moment of this drying or smoothing cylinder 118 forming an extended smoothing nip with the shoe roll 114 (cf. also FIGS. 6 to 11), with ribs also being able to be provided which extend, for example, in the peripheral direction.

The embodiments of FIGS. 1 to 5 admittedly relate primarily to the first aspect of the invention, while the embodiments of FIGS. 6 to 12 primarily relate to the second aspect of the invention. However, in accordance with the invention, any desired combinations of these two aspects of the invention, and thus also of the different embodiments, are possible.

REFERENCE NUMERAL LIST

10 drying section
12 smoothing nip
14 shoe roll
16 paper making machine base
18 drying cylinder
20 web guiding roll
22 material web
24 drying wire
26 drying wire
28 web guiding roll
30 web guiding roll
32 suction box
38 shoe
40 edge
42 outer edge
44 jacket
46 yoke
48 supporting element
50 jacket fixing
52 end plate
54 deflection roll
56 conveyor belt
58 deflection roll
60 suction box
62 hood
64 web stabilizer
66 high vacuum zone
110 drying section

112 smoothing nip
112' smoothing nip
114 shoe roll
114' shoe roll
116 paper making machine base
118 drying cylinder
120 web guiding roll
122 material web
124 drying wire
126 drying wire
128 web guiding roll
130 web guiding roll
132 web guiding roll
134 web guiding roll
136 web guiding roll
138 shoe
140 edge
142 outer edge
144 jacket
146 yoke
148 supporting element
150 jacket fixing
152 end plate
154 suction box
155 deflection roll
156 conveyor belt
158 deflection roll
160 suction box
162 hood
164 web stabilizer
166 high vacuum zone
168 jacket
$H_1$ height
$h_2$height
L web running direction
d spacing
g spacing
h stroke

The invention claimed is:

1. A drying section (10) of a machine for the manufacture of a material web (22), the material web being one of a paper web and a board web, comprising:

a machine base; and two pressing areas lying opposite one another, at least one of said two pressing areas being formed by a shoe roll, thereby forming a smoothing nip (12) which extends in a web running direction (L) between said two pressing areas with at least 70%, of said outer shoe roll diameter lying above said machine base (16), at least one of said two pressing areas being heated having a surface temperature >40° C., a wire delivers the material web proximate to said two pressing areas, the material web being in direct contact with said two pressing areas.

2. A drying section in accordance with claim 1, characterized in that the shoe roll (14) lies completely over the machine base (16).

3. A drying section in accordance with claim 1 or claim 2, characterized in that spacers can be used between the bearing of the shoe roll (14) and a bearing block; and/or in that cantilever elements can be used.

4. A drying section in accordance with claim 1, characterized in that one of the two pressing surfaces is formed by a shoe roll (14) and the other is formed by a roll or by a cylinder, in particular by a drying cylinder (18), with a jacket not flexible in comparison with the shoe roll jacket (44).

5. A drying section in accordance with any one of claim 1, characterized in that both pressing surfaces are each formed by a shoe unit or shoe roll (14).

6. A drying section in accordance with claim 1, characterized in that at least one of the two pressing surfaces is heated.

7. A drying section in accordance with claim 1, characterized in that at least one of the two pressing surfaces is provided as a heated smoothing surface.

8. The drying section in accordance with claim 1, further comprising a hood with a simultaneous inner cooling, said shoe roll (14) being insulated toward the environment by said hood (62).

9. A drying section in accordance with claim 8, characterized in that the shoe roll (14) provided with a hood (62) is cooled by cooling air from the inside and/or outside.

10. A drying section in accordance with claim 1, characterized in that a damping device is provided in front of the extended smoothing nip (12) in the web running direction (L) for the sectional influencing of the web moisture transversely to the web running direction (L).

11. A drying section in accordance with claim 1, characterized in that the extended smoothing nip (12) is arranged in a single row drying group.

12. A drying section in accordance with claim 1, characterized in that the extended smoothing nip is arranged in a two-row drying group.

13. An apparatus for smoothing a material web (22), in particular a paper web or a board web, in particular for use in a drying section (10) in accordance with claim 1, comprising a smoothing nip (12) which is extended in the web running direction (L) and is formed between two pressing surfaces lying opposite one another of which at least one is formed by a shoe roll (14) and of which at least one is heated, with preferably one of the two pressing surfaces being formed by a shoe roll (14) and the other being formed by a drying cylinder (18).

14. An apparatus in accordance with claim 13, characterized in that at least one of the two pressing surfaces is provided as a smoothing surface.

15. An apparatus in accordance with claim 13, characterized in that the drying cylinder (18) has a bending moment increased in comparison with a conventional drying cylinder.

16. The apparatus of claim 15, characterized in that, to increase the bending moment the drying cylinder (18) has an outer diameter >1.5 m.

17. The apparatus of claim 13, wherein said drying cylinder (18) is deflection controlled.

18. An apparatus in accordance with claim 13, characterized in that the smoothing nip (12) is arranged within a wire loop.

19. The apparatus of claim 13, wherein said flexible jacket (44) of said shoe roll (14) is temperature resistant up to approximately 120° C.

20. The apparatus of claim 19, wherein said flexible jacket (44) of said shoe roll (14) consists of elastomeric material on a polymer base.

21. An apparatus in accordance with claim 20, characterized in that the jacket armoring consists of elastomeric material whose modulus of elasticity is larger than the modulus of elasticity of the elastomeric material.

22. An apparatus in accordance with claim 13, characterized in that the oil used for lubrication in the shoe roll (14) is temperature resistant up to 120° C.

23. An apparatus in accordance with claim 22, characterized in that the oil and the elastomeric material are coordinated with one another.

24. An apparatus in accordance with claim 13, characterized in that the outer diameter of the jacket (44) of the shoe roll (14) is >1.8 m.

25. An apparatus in accordance with claim 13, characterized in that one of the two pressing surfaces is formed by a shoe roll (14) and the other is formed by a drying cylinder (18); and in that the outer diameter of the shoe roll (14) is smaller than or equal to the outer diameter of the drying cylinder (18).

26. An apparatus in accordance with claim 13, characterized in that the shoe roll (14) includes a centrally fixed shoe (38).

27. An apparatus in accordance with claim 13, characterized in that the shoe roll (14) includes a shoe (38) cooled by the relevant lubricating oil.

28. An apparatus in accordance with claim 27, characterized in that the shoe roll (14) is provided with means to eliminate the friction which arises between the shoe (38) and the associated pressing unit (48) due to thermal expansion.

29. An apparatus in accordance with claim 28, characterized in that the shoe (38) of the shoe roll (14) can be acted upon sectionally in the transverse direction.

30. The apparatus of claim 13, further comprising a hood having a simultaneous inner cooling arrangement, said shoe roll (14) being insulated toward the environment by said hood (62).

31. An apparatus in accordance with claim 13, characterized in that the shoe roll (14), which is preferably provided with a hood (62), is cooled with cooling air from the inside and/or from the outside.

32. The apparatus of claim 13, further comprising a hood (62) associated with said shoe roll (14) and can be opened upwardly and to the sides at least so far that the opening created is dimensioned at least as large as the outer diameter of the shoe roll (14).

33. The apparatus of claim 13, characterized wherein said two pressing surfaces include edge regions not covered by the material web (22) have a spacing (d) from one another in the smoothing nip plane.

34. The apparatus of claim 13, wherein at least one of said drying cylinder (18) is conically shaped at the edges and a stroke (h) of said shoe (38) associated with said shoe roll (14) is dimensioned, such that a spacing (d) results with respect to the opposing pressing surface at the outer edges (42) of the rotating shoe roll jacket (44), said spacing (d) being >5 mm.

35. An apparatus in accordance with claim 13, characterized in that the drying cylinder (18) is made in stages.

36. The drying section of claim 1, wherein said outer shoe roll diameter is at least 90% above said machine base.

37. The drying section of claim 8, wherein said simultaneous inner cooling arrangement includes a lubricating oil.

38. The apparatus of claim 16, wherein said outer diameter is greater than 1.8 meter.

39. The apparatus of claim 38, wherein said outer diameter is greater than 2 meters.

40. The apparatus of claim 39, wherein said outer diameter is greater than 2.4 meters.

41. The apparatus of claim 16, wherein said drying cylinder includes a ribbed inner peripheral surface.

42. The apparatus of claim 1, wherein said surface temperature is >6° C.

43. The apparatus of claim 19, wherein said flexible jacket consists of a thermally loadable plastic.

44. The apparatus of claim 20, wherein said polymer base is a polyurethane.

45. The apparatus of claim 30, wherein said simultaneous inner cooling arrangement includes a lubricating oil.

46. The apparatus of claim 32, wherein said opening is dimensioned between approximately 1.5 times to approximately 2 times larger than said outer diameter of said shoe roll.

47. The apparatus of claim 34, wherein said spacing is greater than approximately 8 millimeters.

48. The apparatus of claim 47, wherein said spacing is greater than approximately 12 millimeters.

49. A drying section (10) of a machine for the manufacture of a material web (22), the material web being one of a paper web and a board web, comprising:

a machine base;

two pressing areas lying opposite one another, at least one of said two pressing areas being formed by a shoe roll, thereby forming a smoothing nip (12) which extends in a web miming direction (L) between said two pressing areas with at least 70%, of said outer shoe roll diameter lying above said machine base (16), said smoothing nip (12) being arranged within a wire loop, the material web (22) traversing said smoothing nip (12) without any intervening structure between the material web (22) and said two pressing areas.

* * * * *

UNITED STATES PATENT AND TRADEMARK OFFICE

CERTIFICATE OF CORRECTION

PATENT NO. : 7,114,268 B2
APPLICATION NO. : 10/273160
DATED : October 3, 2006
INVENTOR(S) : Muller It is certified that error appears in the above-identified patent and that said Letters Patent is hereby corrected as shown below:

COLUMN 10
At line 13, please delete "hi", and substitute therefore --$h_1$--.

COLUMN 12
At line 41, after "smoothing nip 112 or 112.", a new paragraph should begin.

COLUMN 15
At line 59, in claim 3, please delete "or claim 2".

Signed and Sealed this

Tenth Day of July, 2007

JON W. DUDAS
*Director of the United States Patent and Trademark Office*